US008540654B2

(12) United States Patent
Davis

(10) Patent No.: US 8,540,654 B2
(45) Date of Patent: Sep. 24, 2013

(54) THERAPEUTIC MASSAGE SOCK

(76) Inventor: Reginald J. Davis, Cockeysville, MD (US)

( * ) Notice: Subject to any disclaimer, the term of this patent is extended or adjusted under 35 U.S.C. 154(b) by 948 days.

(21) Appl. No.: 12/383,954

(22) Filed: Mar. 30, 2009

(65) Prior Publication Data

US 2010/0249680 A1 Sep. 30, 2010

(51) Int. Cl.
*A61H 7/00* (2006.01)

(52) U.S. Cl.
USPC ..... 601/152; 601/149

(58) Field of Classification Search
USPC ..... 601/148–152; 602/13; 606/201, 606/202
See application file for complete search history.

(56) References Cited

U.S. PATENT DOCUMENTS

| | | | | |
|---|---|---|---|---|
| 1,213,941 | A | 1/1917 | Patrick | |
| 2,716,293 | A | 8/1955 | Rath | |
| 3,180,039 | A | 4/1965 | Burns, Jr. | |
| 3,888,242 | A * | 6/1975 | Harris et al. | 601/152 |
| 4,372,297 | A * | 2/1983 | Perlin | 601/151 |
| 4,502,470 | A * | 3/1985 | Kiser et al. | 601/151 |
| 4,805,601 | A * | 2/1989 | Eischen, Sr. | 601/151 |
| 5,139,475 | A * | 8/1992 | Robicsek | 602/13 |
| 5,288,286 | A * | 2/1994 | Davis | 602/6 |
| 5,329,640 | A * | 7/1994 | Hourigan | 2/239 |
| 5,613,941 | A * | 3/1997 | Prengler | 602/13 |
| 5,806,208 | A * | 9/1998 | French | 36/28 |
| 5,846,063 | A | 12/1998 | Lakic | |
| 6,409,691 | B1 | 6/2002 | Dakin et al. | |
| 6,589,194 | B1 | 7/2003 | Calderon et al. | |
| 6,945,944 | B2 * | 9/2005 | Kuiper et al. | 602/13 |
| 7,094,212 | B2 * | 8/2006 | Karason et al. | 602/5 |
| 2003/0013997 | A1 * | 1/2003 | Raju | 601/152 |
| 2004/0158285 | A1 * | 8/2004 | Pillai | 606/204 |

FOREIGN PATENT DOCUMENTS

| | | |
|---|---|---|
| GB | A-2263405 | 7/1993 |
| GB | A-2271060 | 4/1996 |

* cited by examiner

*Primary Examiner* — Justine Yu
*Assistant Examiner* — Raymond G Chen
(74) *Attorney, Agent, or Firm* — Ober, Kaler, Grimes & Shriver; Royal W. Craig

(57) ABSTRACT

A pneumatic or hydraulic massage sock including a unitary molded insole formed with one or more internal pump chambers for generating fluid pressure throughout the user's gait, and a plurality of interconnected compression pads each containing an array of fluid feed tubes. The compression pads fold up and around the foot and calf substantially enveloping them in a low-profile sock-like configuration. An outer shell is worn overtop to maintain the compression pads against the user's calf. The fluid feed tubes are in fluid communication with the pump insole to provide a self-compressive non-constricting deep-kneading, undulating (wavelike) pattern massage action up the leg in accordance with the full-length heel-to-ball-to-toe foot plant. The massage sock appears as a conventional sock so it can be worn with virtually any conventional pair of shoes. This provides effective unobtrusive relief for individuals with circulatory disabilities, diabetes, arthritis, etc.

14 Claims, 5 Drawing Sheets

THERAPEUTIC MASSAGE SOCK

CROSS REFERENCE TO RELATED APPLICATIONS

This application claims the benefit of U.S. application Ser. No. 12/011,630 filed 28 Jan. 2008, which is hereby incorporated by reference as if fully set forth herein.

BACKGROUND OF THE INVENTION

1. Field of the Invention

The present invention relates to therapeutic footwear and, more particularly, to a self-compressive massage sock useful for patients susceptible to foot problems resulting from diabetes or other circulatory foot conditions.

2. Discussion of the Related Art

Sitting stationary for long periods of time leads to an impaired venous return in the lower limbs that engenders local gatherings of blood. This causes swelling and discomfort around the ankles. Moreover, the effects of long term sitting can be serious inasmuch as stasis can lead to the formation of blood clots, pulmonary embolisms, etc. Certain segments of the population are more prone to these symptoms, including the elderly and those with diabetes.

Diabetic neuropathies can be classified as peripheral, autonomic, proximal, and focal, each of which affects different parts of the body in different ways. Peripheral neuropathy (or distal symmetric neuropathy) tends to affect the arms and legs with circulation problems. Symptoms include either pain or loss of feeling in the toes, feet, legs, hands, and arms. Blisters and sores may appear on numb areas of the foot, and the loss of sensation in the feet means that such sores or injuries may not be noticed and may become ulcerated or infected. If foot injuries are not treated promptly, the infection may spread to the bone. Indeed, cardiovascular complications resulting from diabetes are the leading cause of lower-limb amputations in diabetics.

It is well-known that diminished circulation in the extremities and particularly the feet can be treated by massage therapy. Consequently, a variety of massaging socks, stockings, shoes and foot pads currently exist. However, these rely primarily on friction to impart the massage, which does little for circulation.

Compression is a more appropriate therapy for those seeking to increase circulation, and compressive devices seeking to prevent or reduce thrombosis have been proposed. For example, an inflatable compression garment is disclosed in GB-A-2271060, and an ambulatory pneumatic compression device is disclosed in GB-A-2263405. Blood circulation in a limb is stimulated by a periodically inflatable sheet which is wrapped around a patient's foot. Unfortunately, this is cumbersome to apply and requires an external pressure source. GB-A-2263405 discloses an orthopedic shoe connected to cells wrapped around the calf and ankle of a user and operable to exert a pumping effect to the cells as the user walks. When the patient walks air is moved from air cells in the heel to cells in the ankle and calf. This sequentially increases the pressure exerted on the patient's ankle and calf, promoting peripheral circulation to treat leg ulcers. While the concept is valid the implementation lacks effectiveness because it relies on constriction which occurs only at the heel strike and uniformly around two collar-like pads wrapped around the ankle. The effect is somewhat less than a massage which should be applied with a kneading, non-constricting undulating (wavelike) pattern-compression motion. Moreover, the user is constrained to wearing just one pair of shoes.

Similarly, U.S. Pat. No. 6,589,194 to Calderon et al. (C-Boot Ltd) issued Jul. 8, 2003 shows a self-powered compression device for promoting circulation and therapeutic compression. The device is self-powered, employing a plurality of inflatable sleeves arranged sequentially for applying compression to a body or limb, and a pump, a piping system and a bandage or boot to enclose the sleeves and pump in their its entirety. The device uses self-generated pressure from walking in promoting circulation for treatment of lymphatic and traumatic edemas, venous disorders, limb ulcers, varicose veins, muscle fatigue, sports medicine, cellulite treatment, diabetic feet, and simple feet massage for recreation or cosmetic enhancements. This device is still rather cumbersome and relies on pure constriction, not a non-constricting variable pattern-compression motion.

U.S. Pat. No. 6,409,691 to Dakin et al. (Daos Limited) issued Jun. 25, 2002 shows a liquid brace with a number of flexible compression bags pressurized by a pump, which may be driven by muscle contracting or weight-bearing activities. The pump may provide a dynamic, oscillatory pressure. The bags are separated by valves allowing the liquid to flow in a controlled manner through the bags.

There are also a variety of inflatable orthotics, such as inner soles with inflated cushions at either the toe and heel areas. The cushions circulate air and ventilate the shoe or boot during walking activities. See, for instance, U.S. Pat. Nos. 3,180,039, 2,716,293 and 1,213,941. However, the inflating pads are for support and do nothing for circulation.

More recently, Nike™ has introduced a sole with integral self-inflating pads. The pads are inflated by an on-board finger pump. Similarly, U.S. Pat. No. 5,846,063 to Lakic discloses an air pump and relief valve assembly that can be sealed to a flat sheet of plastic and embedded in the sole.

It would be greatly advantageous to provide a therapeutic massage sock self-powered by an embedded pump to provide a self-compressive non-constricting and yet deep-kneading, non-constricting undulating (wavelike) pattern-compression massage action, which can be worn with virtually any conventional pair of shoes, to benefit patients susceptible to foot problems resulting from diabetes or other circulatory foot conditions.

SUMMARY OF THE INVENTION

Accordingly, it is an object of the present invention to provide a therapeutic massage sock with embedded full-length heel-to-ball-to-toe foot pump feeding an array of pneumatic or hydraulic tubes that extend up the foot and calf, the fluid feed through the tubes providing a self-compressive, non-constricting and undulating massage action.

It is another object to provide the above-described embedded sole pump and array of tubes in a molded sole structure with integral pads that fold up to envelope the foot and calf in a low-profile configuration, each pad containing an array of internal fluid feed tubes, the enveloping pads being held in place by a fabric shell that looks and feels like a conventional sock, such that the combination can be worn with virtually any conventional pair of shoes.

It is another object to provide a low-cost therapeutic massage sock that is easy to wear, unobtrusive, and aesthetically undetectable, thereby benefitting patients susceptible to foot problems resulting from diabetes or other circulatory foot conditions.

In accordance with the foregoing objects, the present invention is a pneumatic or hydraulic massage sock comprised of a unitary molded insole formed with a plurality of interconnected compression pads. The insole includes a series of internal pump chambers for generating fluid pressure throughout the user's gait. The pump insole feeds the compression pads, each of which contain an array of fluid feed tubes. The compression pads fold up and around the foot and calf substantially envelope them in a low-profile sock-like configuration, the fluid feed tubes therein being in fluid communication with the pumping sole section to provide a self-compressive non-constricting and yet deep-kneading, non-constricting undulating (wavelike) pattern-compression massage action up the leg in accordance with the full-length heel-to-ball-to-toe foot plant. The invention also comprises an outwardly worn fabric shell for holding the pads in place, the shell looking and feeling like a conventional sock, such that the combination can be worn with virtually any conventional pair of shoes. Mere walking produces a heel-to-ball-to-toe pumping force that inflates the fluid feed tubes surrounding the foot and calf in an upwardly-undulating pattern to promote an effective deep-kneading massage. The massage sock offers mild, non-constricting undulating compression and yet are non-intrusive and maintain a low-profile, thereby providing effective relief for individuals with circulatory disabilities, diabetes, arthritis, etc.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to preferred embodiments of the present invention, examples of which are illustrated in the accompanying drawings. Wherever possible, the same reference numbers will be used throughout the drawings to refer to the same or like parts. Hereinafter, a therapeutic massage sock is described which includes a self-powered pump embedded in a molded insole, the pump feeding a plurality of compression pads wrapped up and about the foot and leg to provide a self-compressive non-constricting and yet deep-kneading, undulating (wavelike) pattern-compression massage action.

Figure 1:
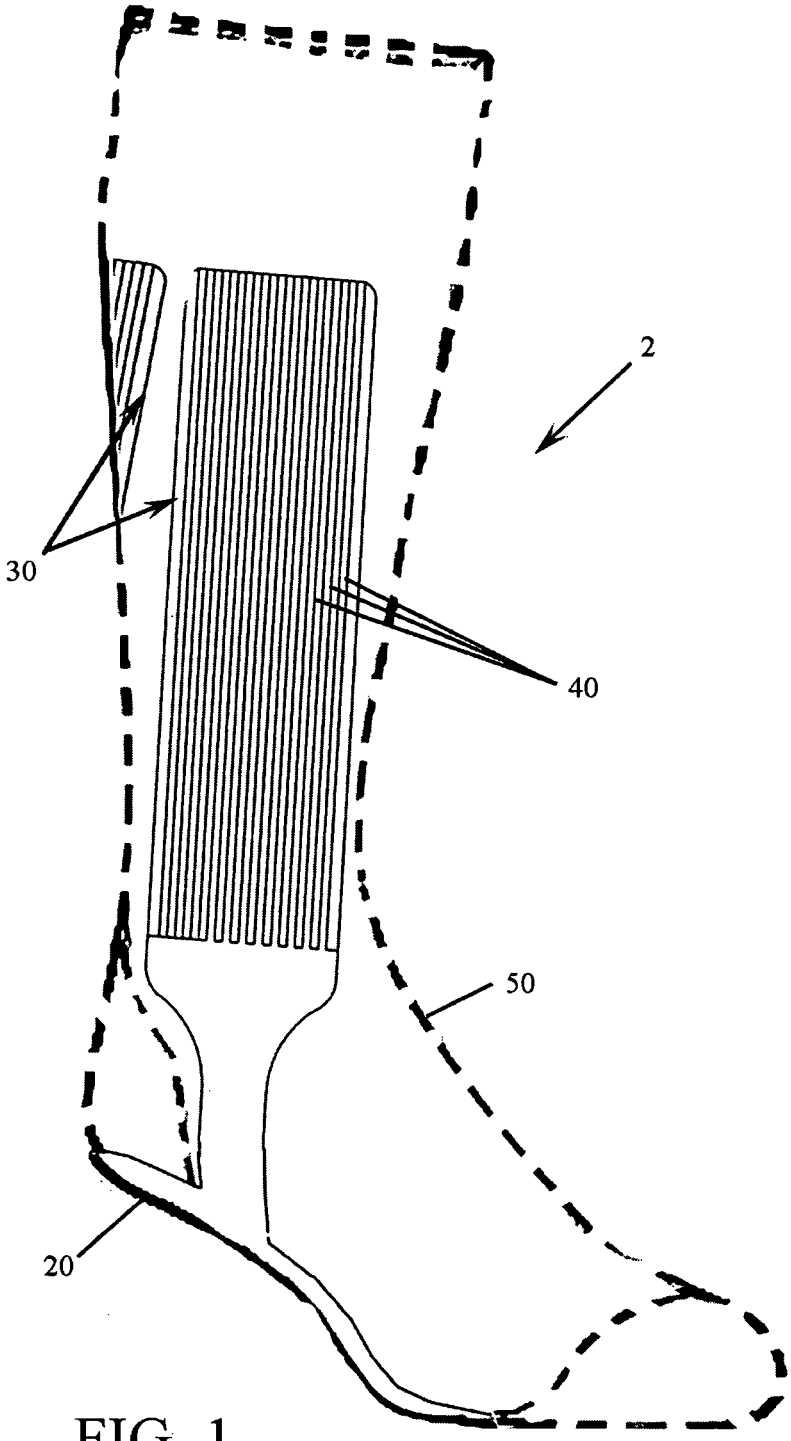
FIG. 1 is a perspective view of the therapeutic massage sock 2 according one embodiment of the present invention.

FIG. 1 is a perspective view of the therapeutic massage sock 2 according an embodiment of the present invention. Therapeutic massage sock 2 generally includes a unitary molded insole 20 formed with a plurality of interconnected compression pads 30. The insole 30 includes a series of internal pump chambers (to be described) for generating fluid pressure throughout the user's gait. The pump chambers in insole 20 feed the compression pads 30, each of which contain an array of fluid feed tubes 40. The compression pads 30 fold up and around the foot and calf as shown, substantially enveloping them in a low-profile sock-like configuration. A fabric shell 50 is worn overtop to keep the compression pads 30 in place. The fluid feed tubes 40 are in fluid communication with the pumping insole 20 to provide a self-compressive non-constricting, undulating (wavelike) pattern massage action up the foot and leg in accordance with the full-length heel-to-ball-to-toe foot plant, thereby providing effective relief for individuals with circulatory disabilities, diabetes, arthritis. The device 2 can be worn with virtually any conventional pair of shoes, and to onlookers it appears like a conventional sock.

Figure 2:
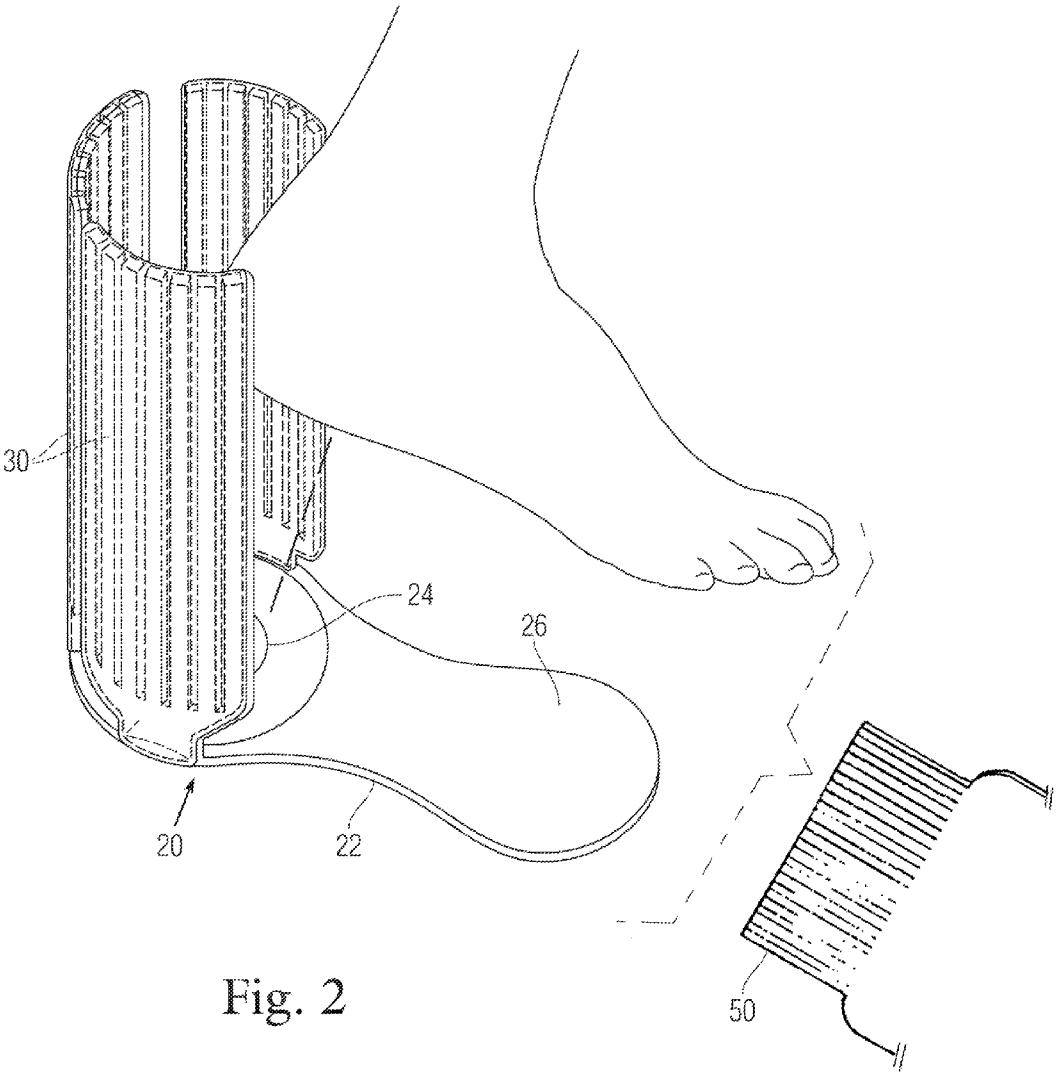
FIG. 2 is a perspective view illustrating how the components of the therapeutic massage sock 2 are worn.

FIG. 2 shows how the components of the therapeutic massage sock 2 are worn. A user places their foot on the pump insole 20 and folds the plurality of compression pads 30 straight up around the foot and calf as shown. Once folded upward, the compression pads 30 cover a majority of the area between the ankle and the knee, substantially surrounding and enveloping the calf yet keeping a low-profile configuration. After the pumping insole 20 is donned, the fabric shell 50 is slipped overtop to maintain the compression pads 30 in place. The fluid feed tubes 40 inside the compression pads 30 are in fluid communication with the pumping insole 20 to provide a self-compressive non-constricting, undulating (wavelike) pattern massage action up the foot and leg in order to provide effective relief for individuals with circulatory disabilities, diabetes, arthritis. The fabric shell 50 can be cotton or synthetic fabric that likewise conforms to the foot and calf. Thus, the massage sock 2 can be worn over-the-calf in most any natural day-to-day situation. The device 2 can be worn with virtually any conventional pair of shoes, and to onlookers it appears like a conventional sock.

Figure 3:
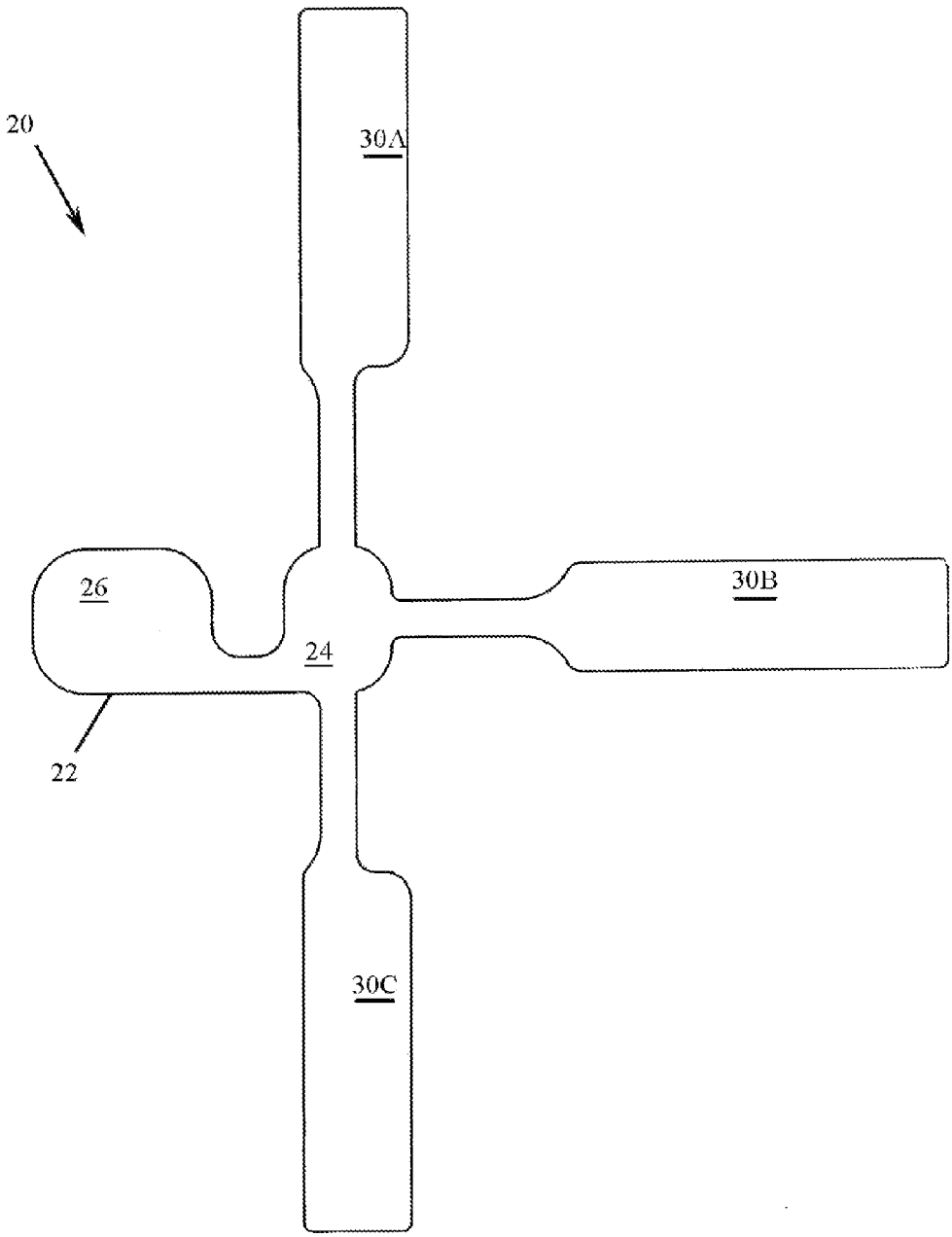
FIG. 3 is a top view of the pump insole 20 of the therapeutic massage sock 2 of FIGS. 1-2.

FIG. 3 is a top view of the pump insole 20 of the therapeutic massage sock 2 of FIGS. 1-2. The pump insole 20 may be integrally molded of silicone rubber or other suitable elastomer and includes a plurality of internal chambers. The illustrated embodiment includes separate but interconnected heel 24 and ball 26 chambers for progressively circulating fluid throughout the fluid feed tubes 40 of compression pads 30, which are in fluid connection to the pump insole 20.) In a hydraulic embodiment the chambers 24, 26 may be filled with a liquid. In a pneumatic embodiment the chambers 24, 26 may be filled with air or may have vents or perforations adapted to draw air in and expel it. A plurality of channels extend from the chambers 24, 26 and are in fluid communication with the tubes 40 (FIG. 3). When the user walks air/fluid is pumped out of the chambers 24, 26 and is forced into the tubes 40 for patterned distribution to the ankle and calf, thereby sequentially increasing the pressure exerted on the user's ankle and calf.

Although two chambers (heel 24 and ball 26) are shown, it is possible to include more such as three (heel, midsole and ball). Likewise, the illustrated embodiment includes three interconnected compression pads 30A, 30B, 30C radially spaced about the heel chamber 24 at the sides and rear of the foot. Two or more compression pads 30 are possible, though in order to maximize surface coverage within the illustrated dimensions, three is considered optimal. FIG. 3 includes a complete set of exemplary dimensions (in inches) which are suitable for substantially covering the calf with the compression pads 30A-30C. Given three pads 30A-C formed with the illustrated dimensions, the compression pads 30 once folded upward serve to cover a majority of the area between the ankle and the knee, substantially surrounding and enveloping the calf yet maintaining a low-profile configuration.

Figure 4:
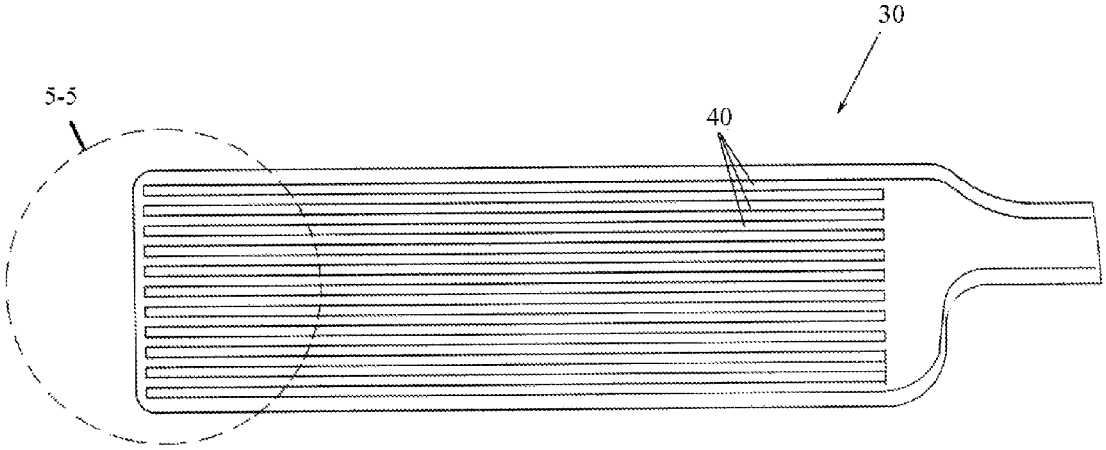
FIG. 4 is an enlarged view of a compression pad 30 from the pump insole 20 of FIG. 3.
Figure 5:
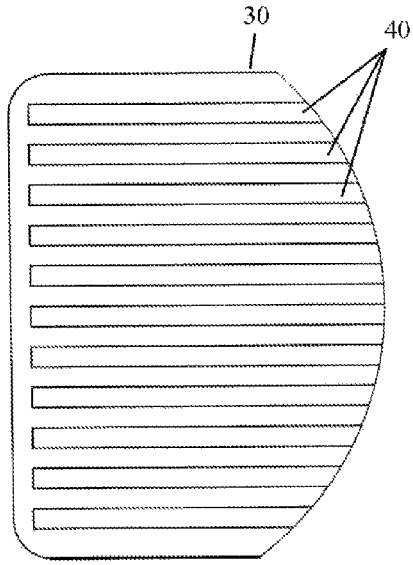
FIG. 5 is an enlarged view of the fluid feed tubes 40 in the compression pad 30 of FIG. 3.

FIG. 4 is an enlarged view of a compression pad 30 as in FIG. 3, and FIG. 5 is a further-enlarged view of the area B of FIG. 4 which shows the fluid feed tubes 40. Each compression pad 30 is formed as a flat paddle-shaped member with an internally-molded array of fluid-feed tubes 40. All of the fluid feed tubes 40 in each compression pad 30 are in sealed fluid communication with the pump chambers 24, 26 of the pump insole 20 via a central port through the stem of the compression pad 30 which branches into the fluid feed tubes 40. All of the fluid feed tubes are preferably parallel-arranged for simplicity of molding, although a non-linear web of feed tubes 40 is also considered within the scope and spirit of the invention. The individual tubes 40 may be interconnected in various other patterns (other than linear) such as a lattice-work mesh, or spider-web mesh running upward along the foot and leg. One skilled in the art will readily understand that a variety of suitable patterns may be adapted depending on the desired massage effect. In the illustrated embodiment, each compression pad 30 contains eleven parallel feed tubes 40 each with circular or square cross-section of approximately 0.125 width/diameter. The patterned array of tubes 40 conforms to the foot and calf and runs upward along the foot/leg so that fluid pumped there through induces a kneading sensation moving up the leg.

In use, mere walking or running produces a cumulative heel-to-ball-to-toe pump force as the separate heel 24 and ball 26 regions of pump 22 strike down, and this injects the fluid through the stems of the surrounding compression pads 30 and into the fluid feed tubes 40, thereby inflating the upper array of tubes 40 and constricting the foot/calf in an outwardly undulating pattern. The rate and direction of spread and hence the massage pattern may be governed by the particular pattern of tubes 40 chosen as well as flow valves 60 positioned within the flow path. Similarly, lifting the foot eases pressure and the fluid returns to the pump insole 20, resulting in a cyclic pattern of fluid flow progressing up then down the leg to promote an effective kneading-type massage, and more effective relief for individuals with circulatory disabilities, diabetes, arthritis, etc.

If necessary, optional one-way or calibrated orifice valves 60 may be interspaced anywhere along the pump chamber 24, 26 or feed tube 40 pathways for controlling the flow of fluid (air or liquid) therein.

Figure 6:
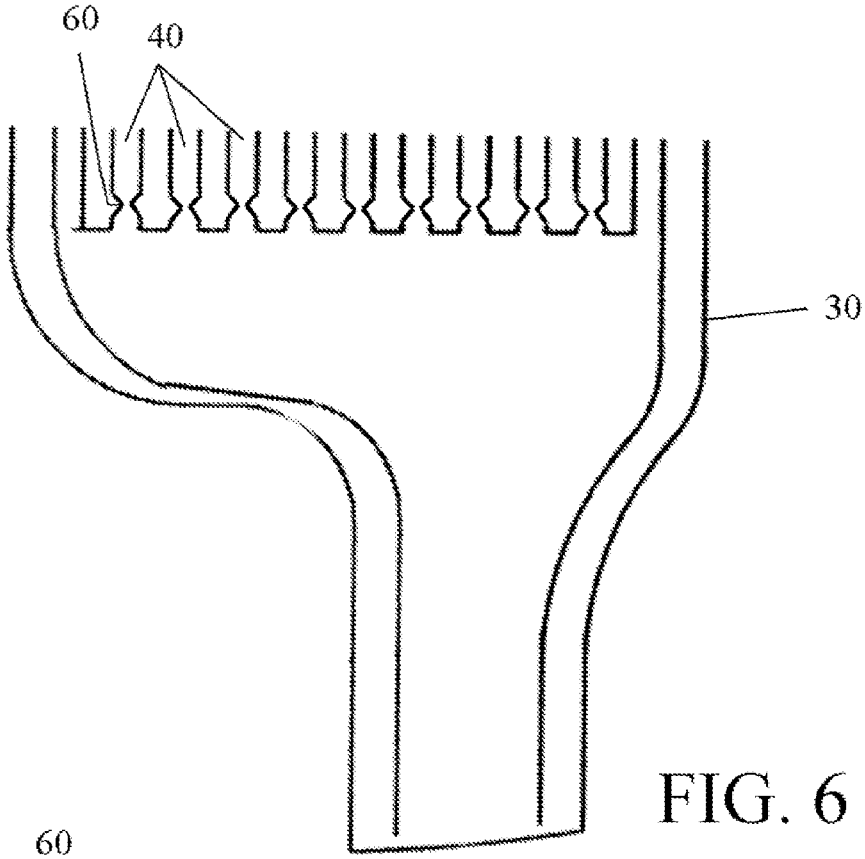
FIG. 6 illustrates the integrally-molded fluid channels 40 within the walls of the compression pad 30, with enlarged insets of two exemplary flow valves 60, including a calibrated orifice valve at FIG. 6(A) and one-way valve at FIG. 6(B).
Figure 6A:
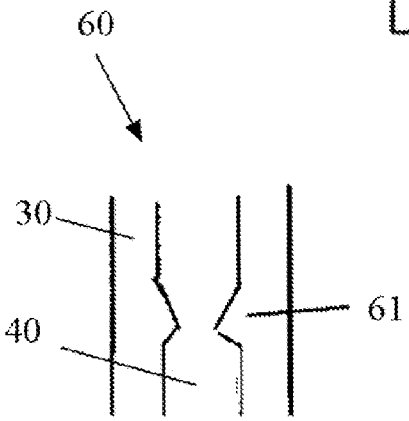
Figure 6B:
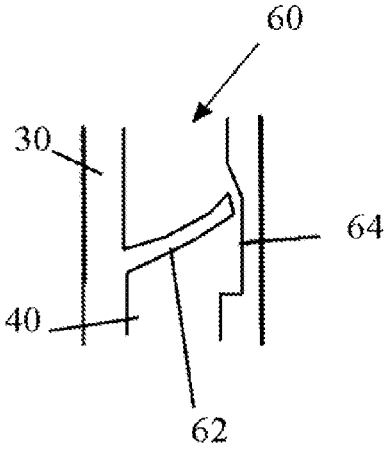

FIG. 6 illustrates two exemplary flow valves 60, including a calibrated orifice valve at (A) and one-way valve at (B), either of which may be used along the fluid flow path to control fluid flow. Each flow valve 60 may be integrally-molded within the fluid channel 40 walls of the compression pad 30 as shown, or within the central conduit within the stem of the compression pads 30, or proximate the pump insole 20. The calibrated orifice valve at (A) comprises a simple flow restriction formed as an annular protruberance in the wall constricting the flow passage, while the one-way valve at (B) comprises a flap 62 seated within a recess 64 in the flow passage and disposed for opening upon fluid and closing upon backwash. If desired, the purpose of the valves 60 is to retard the flow of air/liquid as it moves upward throughout the flow tubes 40. The valves 60 may be positioned anywhere along the tubes 40 to control the rate by which the tubes 40 progressively inflate toward the bottom of the foot (proximate pump insole 20) and upward as the air/liquid makes its way through the valves 60 and into the upper extent of the tubes 40. The sequentially increasing pressure exerted upward along the leg provides an undulating more effective kneading-type massage, and more effective relief for individuals with circulatory disabilities, diabetes, arthritis, etc.

One skilled in the art will readily understand that the purpose of the valves 60 may be assumed by controlling or constricting internal cross-section of the tubes 4. Either way, the foregoing massage sock 2 provides an excellent self-compressive, non-constricting and yet deep-kneading patterned massage action upward along the foot and leg for more effective relief from tired feet, and more comprehensive treatment of foot problems resulting from diabetes or other circulatory foot conditions.

The fabric shell 50 can be any suitable cotton or synthetic fabric sewn into a sock configuration in order to fit over the massage sock 2 and likewise conform to the foot and calf. This holds the compression pads 30 in place, and creates a very low unobtrusive profile device that can be worn with virtually any conventional pair of shoes. Thus, the massage sock 2 can be worn over-the-calf in most any natural day-to-day situation.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A therapeutic massage sock, comprising:

a flexible insole formed with at least one internal pump chamber for generating fluid pressure upon a user's footstrike;

a plurality of compression pads extending radially around said internal pump chamber, each compression pad comprising a flat, paddle-shaped member formed of an elastomeric material with a stem having a conduit in communication with said internal pump chamber, and an internal array of fluid flow channels molded in said elastomeric material, said array of fluid flow channels being in fluid communication with said internal pump chamber through the conduit of said stem, said array of fluid flow channels further comprising a plurality of integrally-molded fluid flow channels spaced parallel to one another across a flat of said paddle-shaped compression pad, and a plurality of valves wherein each valve resident in a corresponding channel of said plurality of fluid flow channels proximate the stem to control fluid flow therein;

whereby said plurality of compression pads are adapted to fold up and around a user's calf to substantially envelope the user's calf so that the internal fluid flow channels extend upward from a user's ankle across the user's calf and collectively surround said user's calf, and said plurality of compression pads are adapted to provide a self-compressive undulating massage action up a user's leg when said user's footstrike operates said internal pump chamber to force fluid from said internal pump chamber upward along said fluid flow tubes.

2. The therapeutic massage sock according to claim 1, wherein said at least one internal pump chamber comprises a plurality of internal pump chambers for generating fluid pressure throughout the user's footstrike.

3. The therapeutic massage sock according to claim 2, wherein said plurality of internal pump chambers comprises an internal heel chamber coupled to an internal ball-of-foot chamber for generating fluid pressure in accordance with the user's heel-to-ball footstrike.

4. The therapeutic massage sock according to claim 1, further comprising a fabric shell worn outwardly of said flexible insole and compression pads for holding the compression pads in place.

5. The therapeutic massage sock according to claim 4, wherein said flexible insole and fabric shell are adapted to be worn inside a shoe.

6. The therapeutic massage sock according to claim 1, wherein said plurality of compression pads further comprises three compression pads extending radially from around the at least one internal pump chamber.

7. The therapeutic massage sock according to claim 1, wherein said at least one internal pump chamber is filled with fluid.

8. A therapeutic massage sock, comprising:

an insole including an internal pump for circulating air or fluid at each heel and forefoot strike; and at least one compression pad integrally joined to said insole, each of said at least one compression pads comprising a flat, flexible paddle-shaped member formed of an elastomeric material with a stem defined by a conduit in communication with said internal pump chamber and branched to a plurality of internally-defined fluid-flow channels molded in a flat of said paddle-shaped member, said internally-defined fluid flow channels further comprising a plurality of integrally-molded fluid flow channels formed in the elastomeric material spaced parallel to one another across a flat of said compression pad and in fluid communication with said internal pump, and a plurality of valves wherein each valve in a corresponding channel of said plurality of fluid flow channels to control fluid flow therein;

said at least one compression pads deployable up and around a user's calf to substantially envelope the user's calf so that the internal fluid flow channels extend upward from the user's ankle across the user's calf and collectively surround said user's calf, whereby each heel and forefoot strike of a user's stride is adapted to initiate a self-compressive, non-constricting pattern of inflation of said fluid flow channels in a kneading patterned massage action spreading progressively upward along a user's foot and leg.

9. The therapeutic massage sock according to claim 8, wherein said insole is flexible and formed with a plurality of internal pump chambers for generating fluid pressure throughout a user's heel and forefoot strike.

10. The therapeutic massage sock according to claim 9, wherein said flexible insole is formed with an internal heel chamber coupled to an internal ball-of-foot chamber for generating fluid pressure in accordance with the user's heel-to-ball footstrike.

11. The therapeutic massage sock according to claim 8, further comprising a fabric shell worn outwardly of said insole and said at least one compression pad for holding said at least one compression pad in place.

12. The therapeutic massage sock according to claim 11, wherein said insole and fabric shell are adapted to be worn inside a shoe.

13. The therapeutic massage sock according to claim 11, wherein said at least one compression pad further comprises three compression pads extending radially from around the internal pump.

14. The therapeutic massage sock according to claim 8, wherein said internal pump is filled with fluid.

* * * * *